United States Patent [19]

Rattin

[11] 4,253,759

[45] Mar. 3, 1981

[54] COPY MACHINE HAVING DUPLEXING FEATURE

[75] Inventor: Luciano Rattin, Ivrea, Italy

[73] Assignee: Ing. C. Olivetti & C., S.p.A., Ivrea, Italy

[21] Appl. No.: 962,676

[22] Filed: Nov. 21, 1978

[30] Foreign Application Priority Data

Nov. 25, 1977 [IT] Italy ..... 69657 A/77

[51] Int. Cl.[3] ..... G03G 15/00; G03G 15/22

[52] U.S. Cl. ..... 355/14 SH; 271/3.1; 271/95; 271/171; 355/3 R; 355/3 SH

[58] Field of Search ..... 355/3 R, 3 SH, 14 R, 355/14 SH, 23, 24, 26; 271/3.1, 4, 5, 95, 171

[56] References Cited

U.S. PATENT DOCUMENTS

| | | | |
|---|---|---|---|
| 2,111,024 | 3/1938 | Donnellan | 271/95 UX |
| 2,601,984 | 7/1952 | Pope | 271/95 |
| 3,592,464 | 7/1971 | Kanda | 271/171 X |
| 3,869,202 | 3/1975 | Tabata et al. | 355/23 X |
| 4,032,136 | 6/1977 | Komaba et al. | 271/171 X |
| 4,099,150 | 7/1978 | Connin | 355/3 R |
| 4,116,558 | 9/1978 | Adamek et al. | 355/24 |
| 4,132,398 | 1/1979 | Erdmann et al. | 271/95 X |

OTHER PUBLICATIONS

Allen et al., "Aligning Paper Tray", IBM Technical Disclosure Bulletin, vol. 19, No. 9, Feb. 1977, p. 3290.

Kollar et al., "Paper Supply Duplex Bin", IBM Technical Disclosure Bulletin, vol. 19, No. 5, Oct. 1976, pp. 1587 and 1588.

*Primary Examiner*—Fred L. Braun

*Attorney, Agent, or Firm*—W. R. Hulbert

[57] ABSTRACT

An electrophotographic copying machine having duplexing mode of operation and first and second selectively enabled sheet supply stations. The first supply station has a feeding device which turns the copy sheet to be fed upside down before delivering it to the conveyor moving the copy-sheet toward transfer station. In the duplexing mode of operation sheets fed from the second station are one side imaged along the copy-sheet path and are collected in the first section. Then one side imaged copy sheets are fed from the first supply station and are imaged on the other side along the copy-sheet path. A storage tray with adjustable stops is provided in said first supply station to handle copy sheets of different formats.

6 Claims, 10 Drawing Figures

ALT
NON
ZER
STO
PRI
JA
U3
ERV
MC
AL
RV
BV
AV
U0
VAI
ZER
PRI
KB
CL
DISP
MAN
MOV
UGU
MUL
FS
SEL
NON

COPY MACHINE HAVING DUPLEXING FEATURE

BACKGROUND OF THE INVENTION

The present invention refers to an electrophotographic copying machine of the type having the "duplex" or "rectoverso" feature, that is the feature of reproducing original images on both sides of copy sheets.

Copying machines of the above type are known, for instance from U.S. Pat. No. 3,615,129, in which such a feature is obtained by providing in the machine a special path for reversing a copysheet, upon one side of which an image has already been reproduced, and for re-feeding such copysheet towards the transfer station of the machine for reproducing a second image on the other side of the copysheet, by the use of additional and complex devices which considerably increase the cost of the machine.

OBJECT AND SUMMARY OF THE PRESENT INVENTION

An object of the present invention is therefore that of providing an electrophotographic copying machine, in which the location of the usual stations in the machine and the geometry of the copy paper path are such that the duplexing feature is obtained in a simple manner without use of special devices.

In accordance with the invention there is provided an electrophotographic copying machine comprising: a photoconductive member; means for cyclically moving the photoconductive member along an endless path; a plurality of stations positioned adjacent and regularly spaced along the endless path for the execution of the usual copy process steps, including: a member charging station, a member developing station, an image transfer station, a copy sheet pick off station and a member cleaning station; a copy sheet fixing station spaced apart from the endless path; first and second, selectively enabled, copy sheets supply stations also spaced apart from the endless path; first conveying means for conveying a copy sheet along a copy sheet path starting from either the first or the second supply station and passing through the transfer, pick off and fixing stations in order; storage means in each of supply station for storing a stack of copy sheets; a feeding device in each supply station, including means for picking up the first sheet of the stack and means for turning it upside down and for thereafter delivering it to the first conveying means defining an exit from the machine to a sheet collector; second conveying means for conveying a finished copy sheet from the output of the fixing station into the storage means of the first supply station; deflecting means at the output of the fixing station selectively positioned in a first or second position in which it deflects a finished copy sheet toward the above named exit or toward the second conveying means, respectively; means for defining a simplex or duplex mode of operation for the machine; selecting means for enabling the first or second supply stations in the simplex mode of operation; means for setting a desired number of copies; copy cycle executing means actuable for the execution of a number of copy cycles equal to the desired number, during each of which a copy sheet fed from the enabled supply station is imaged along a copy sheet path and delivered at the output of the fixing station; first control means enabled in the simplex mode for positioning the deflector in its first position and for thereafter actuating the copy cycle executing means; second control means, enabled in the duplex mode of operation for positioning the deflector in its second position, for enabling the second station and for thereafter actuating the executing means whereby the desired number of one-side imaged copy sheets are stored in the storage means of the first supply station; and third control means enabled in the duplex mode after completion of operation of said second control means, for positioning the deflector in its first position, for enabling the first supply station and for thereafter actuating the executing means, whereby the desired number of both-sides image copy sheets are delivered to the sheet collector exit, the deflector also having a third position in which it deflects finished copy sheets towards a sorter-exit of the machine and means for selectively positioning the deflector in its third position in the simplex mode, or in the duplex mode, during operation of the first or third control means, respectively.

The invention also includes storage means for the first supply station comprising; a container for the stack having a movable stack support plane upon which the stack is positioned; means for raising the support plane for maintaining the first sheet of the stack in contact with the feeding device; a plurality of pairs of lateral and front edge stops each pair of stops corresponding to a copy sheet format and the stops of each pair having rest positions under the support plane, and operative positions in which they extend through slots in the plane for registering a stack of sheets of the corresponding format; and selector means connected to each front and lateral edge stops pair for contemporaneously moving selected lateral and front stops corresponding to a selected format into operative position, the lateral edge stops being mounted axially spaced in different angular positions and in correspondence with their slots on a first shaft extending under said support plane, the front edge stops being mounted axially spaced in different angular positions and in correspondence with their slots on a second shaft extending perpendicularly to the first shaft under the support plane, means being provided for rotationally connecting the first and second shafts to each other, and a selector being provided for contemporaneously selectively adjusting the shafts into a plurality of angular positions in each of which the front and lateral edge stops, corresponding to a selected format, extend through the aforementioned slots.

Still further, the invention contemplates an electrophotographic copying machine, comprising a copying device; first and second selectively enabled copy sheets supply stations, each having storage means for storing a stack of copy sheets of predetermined format; collecting means for collecting finished copy sheets; sorter exit means for selectively defining a simplex and a duplex mode of operation of the machine; first conveying means for conveying a copy sheet fed from the enabled one of the supply stations, through the copying device to form a finished copy imaged on one side of a copy sheet, toward the collecting means; second conveying means, selectively enabled in the duplex mode, for conveying a one side imaged copy sheet from the copying device into the storage means of the first supply station; third conveying means for conveying a finished copy sheet from the copying device toward the sorter exit means; and three-way deflecting means, located at the output of the copying device, selectively actuable for directing a finished copy sheet toward a selected one of the first, second and third conveying means.

A preferred embodiment includes copy cycle executing means actuable for executing a preselected number of copy cycles during each of which a copy sheet fed from an enabled one of the supply stations is processed and delivered at the output of the conveying device; first control means enabled in the simplex mode for positioning the deflecting means to direct imaged copy sheets toward the collecting means and for thereafter actuating the executing means to image a copy sheet on one side; second control means enabled in the duplex mode for positioning the deflecting means to direct imaged copy sheets toward storage means and for thereafter actuating the executing means, whereby a preselected number of one side imaged copy sheets are temporarily stored in the storage means of the first supply station; third control means, selectively enabled in the duplex mode after completion of operation of the second control means, for enabling the first supply station and for thereafter actuating the executing means; and means for selectively positioning the deflecting means to direct imaged copy sheets toward the sorter exit means in the simplex and in the duplex mode during operation of the first or third control means respectively, whereby the preselected number of both sides imaged copy sheets are delivered through the sorter exit means for collection in the sorter.

The foregoing and other objects, features and advantages of the invention will become evident from the following detailed description of a preferred embodiment, taken in conjunction with the annexed drawings.

BRIEF DESCRIPTION OF THE DRAWINGS

This and other objects of the present invention will be clear from the following description, made by way of example, with reference to the accompanying drawings in which.

DESCRIPTION OF THE PREFERRED EMBODIMENT

Figure 1:
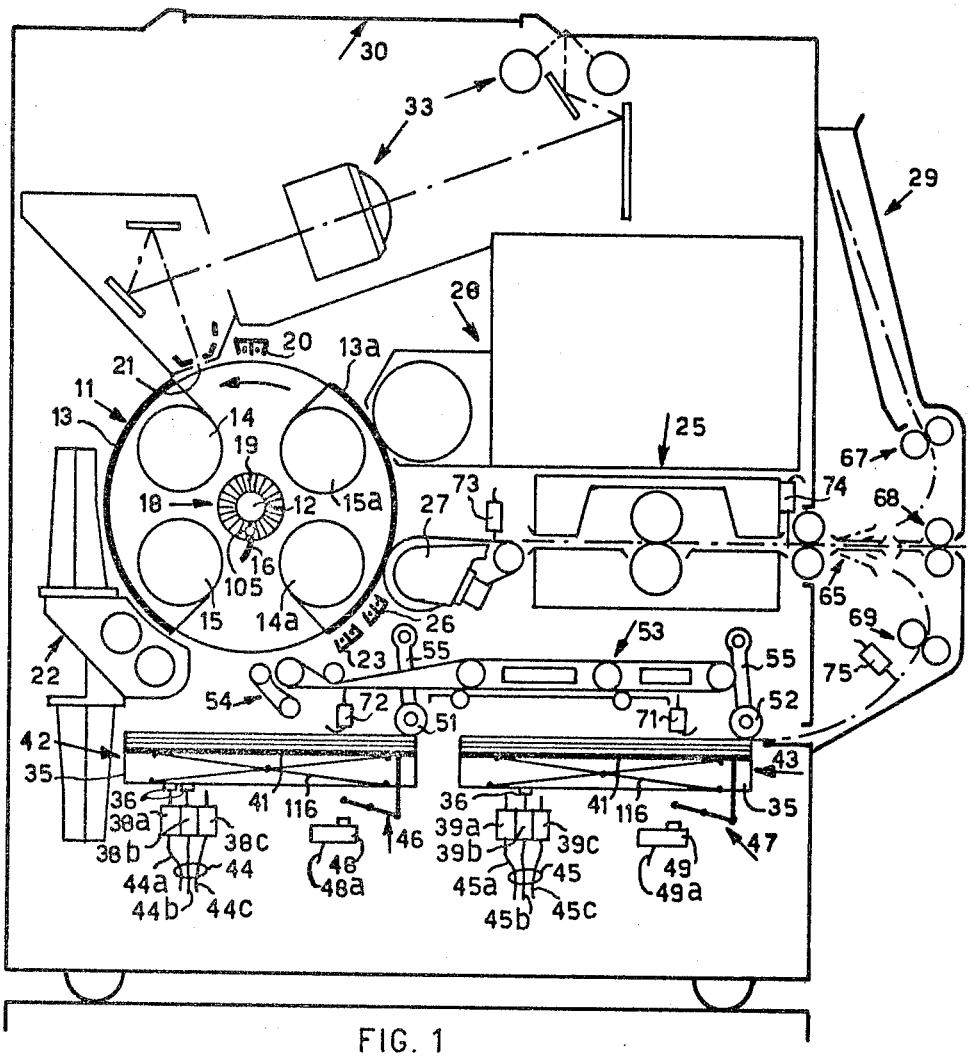
FIG. 1 is a front view of an electrophotographic machine according to the invention.

With reference to FIG. 1 the copying machine comprises a photo-conductive cylindrical drum 11, of the type described in U.S. application Ser. No. 757,537, filed on Jan. 7, 1977, now U.S. Pat. No. 4,129,378, issued Dec. 12, 1978, rotatably mounted on shaft 12 and bearing wound on its outer surface two photoconductive bands 13 and 13*a* fed by feeding reels 14 and 14*a* and rewound on take up reels 15 and 15*a* mounted inside the drum 11. During the copying operation, by the rotation of the drum 11 copies are alternatively made through band 13 and 13*a*. Around the adjacent the periphery of the drum 11, are mounted the usual devices of the copy machines: a D.C. corona charging device 20 for electrostatically charging the photoconductive bands 13 and 13*a*; an exposure window 21 through which the photoconductive band 13 or 13*a* are exposed to the light image of the original; a magnetic brush developing device 22, of known type, by means of which the latent electrostatic image, formed on the photoconductive bands 13 or 13*a*, is visually developed by toner particles; a D.C. corona charging device 23, for transferring the toned image from the photoconductive band 13 or 13*a* to a copy-sheet contacting the band 13 or 13*a* near the charging device 23; an A.C. corona charging device 26 and a sheet detaching device 27 for picking off the copy sheet from the photoconductive band 13 or 13*a* after transfer; and a cleaning device for the photoconductive bands 13 and 13*a*.

The original to be reproduced is positioned on the illumination plane 30 and is light-scanned by means of the movable optical system 33, of the type disclosed in U.S. Pat. No. 3,614,222, suitable to focus the original light image on the exposure window 21. The copy machine has two copy sheets storage and feeding stations 42 and 43 which are located on the same side of the drum 11 and on a common horizontal plane and from which the copy sheets are selectively fed by feeding devices 51 and 52 and advanced by the conveying means 53 and 54 to the image transfer station 23. From the transfer station 23 the copy sheet is picked off by the devices 26 and 27 and advanced through a heated rolls fixing unit of known type.

The copy machine has the capability to handle copy sheets of various formats, for example the copy sheets formats listed in the following table 1.

TABLE I

| FORMAT | LONGITUDINAL DIMENSION mm. | TRANSVERSE DIMENSION mm. |
|---|---|---|
| UNI A4 | 297 | 217 |
| UNI B4 | 364 | 257 |
| PROTOCOLLO | 330 | 216 |

The copy machine includes a plurality of monoformat sheet trays 35, each for format handled by the machine, and each being removably mounted in one of the feed stations 42 or 43.

Each tray 35 has in a predetermined zone of its lateral sides and in coded positions, up to three tongues 36 suitable to identify, by their presence (or absence), the format of the sheets stacked in the tray 35.

Figure 5:
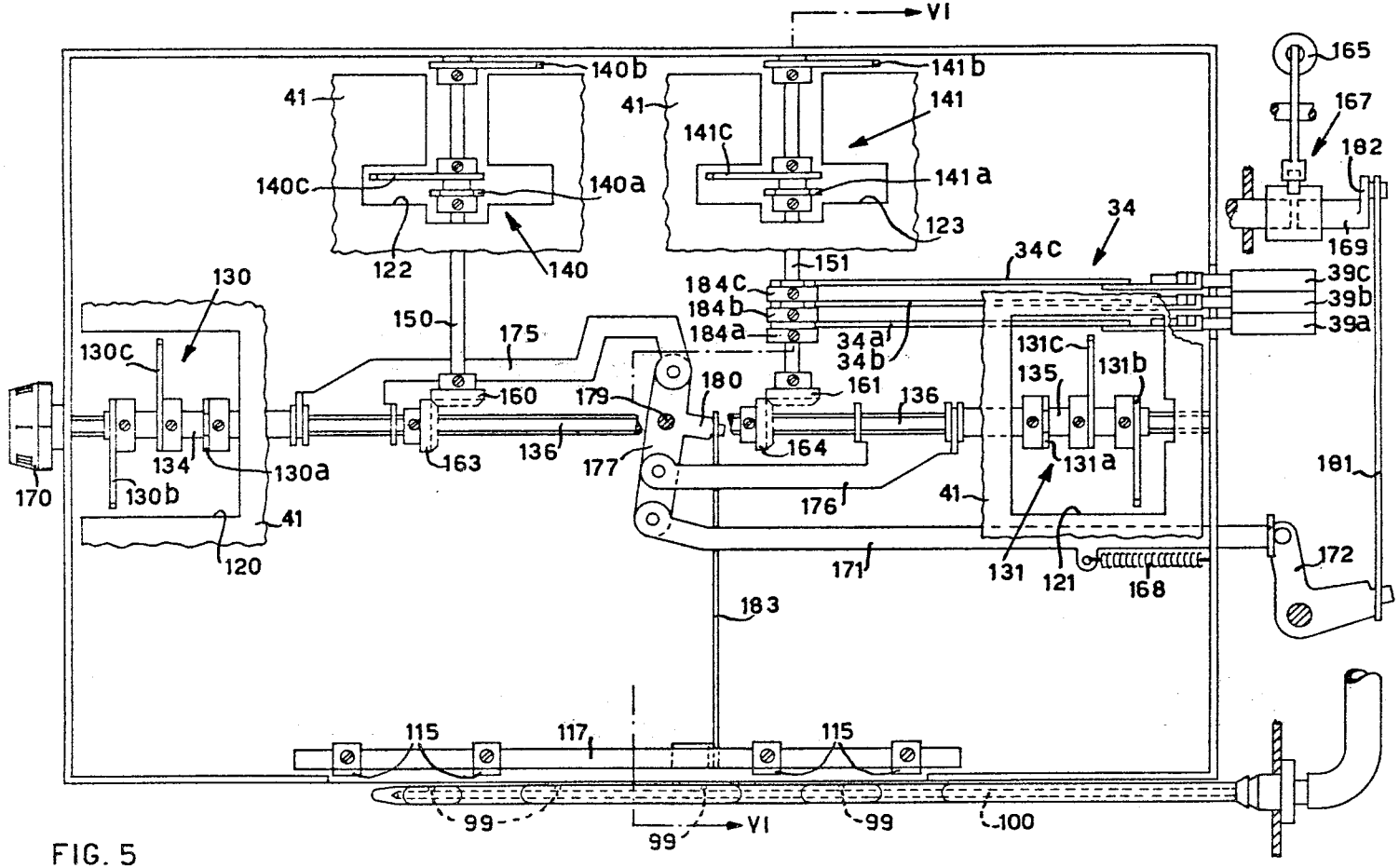
FIG. 5 is a planar view of a multiformat copy-sheet tray 40 positioned in the feeding station 43 of the copying machine of FIG. 1.

The copy machine also includes at least a multiformat tray 40 (FIGS. 5 and 6) which is useful for the execution of the duplexing feature and which will be described in detail later. The multiformat tray 40 includes three code bars 34, selectively movable, for defining the format of the sheets stacked therein. Each tray 35 or 40 further includes a device 116 for raising its sheet supporting plane 41 (FIG. 1), of known type, in order to maintain the first sheet of the stack in contact with the feeding device 51 or 52, independently of the height of the stack, for instance by means of a system of scissors levers as described in U.S. Pat. No. 4,078,788.

Each feeding station 42 or 43 can receive one of the monoformat trays 35, while the multiformat tray 40 can be positioned only in the station 43.

Each feeding station 42 and 43 is provided with microswitches 38*a,b,c* and 39*a,b,c,* respectively which are actuated by the tongues 36 or by the code bars 34 of the respective trays 35, 36 and 40 positioned in station 42 or 43, and which generate, when switched on, a digital signal at logical One level in wires 44*a, b, c,* or, respectively, 45*a,b,c,* which constitute, respectively, channels 44 and 45 connected to the control unit of the copying machine.

The correspondence between the digital codes generated on channels 44 or 45 and the trays 35 and 40 are listed in the following TABLE II.

TABLE II

| FORMAT | CODE GENERATED BY A MONO-FORMAT CONTAINER 35 | CODE GENERATED BY A MULTIFORMAT CONTAINER 40 |
|---|---|---|
| UNI A4 | 001 | 101 |
| UNI B4 | 010 | 110 |
| PROTOCOLLO | 011 | 111 |

Figure 7:
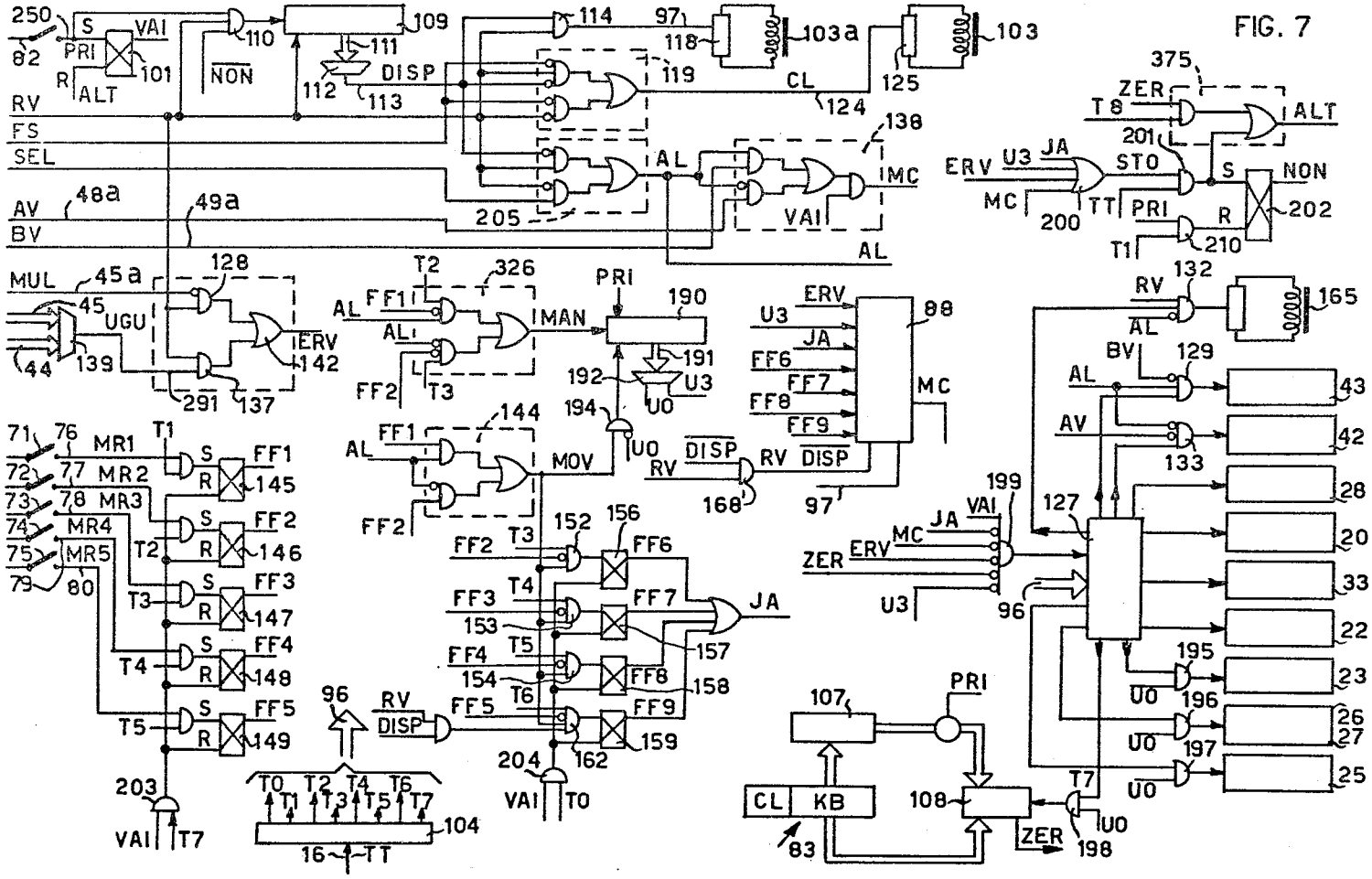
FIG. 7 is a logic circuit of the control unit of the copying machine of FIG. 1.

Each of the two feeding stations 42 and 43 further comprises a sensor element, 46 and 47 respectively, of known type, for sensing the presence of sheets in tray 35 or 40 positioned in the units 42 or 43 and suitable for switching on a microswitch 48 or, respectively, 49, when no sheet is present on such trays. The switching on of the microswitches 48 and, respectively, 49 generates a digital signal at logical One level AV and, respectively, BV on wires 48*a* and, respectively, 49*a* which are connected to the control unit of the machine (FIG. 7).

The trays 35 are mounted in each feeding station 42 or 43 in such a manner that the edge of the copy sheet corresponding to the greater or longitudinal dimension of the sheet is picked up by the feeding devices 51 or 52.

Figure 3:
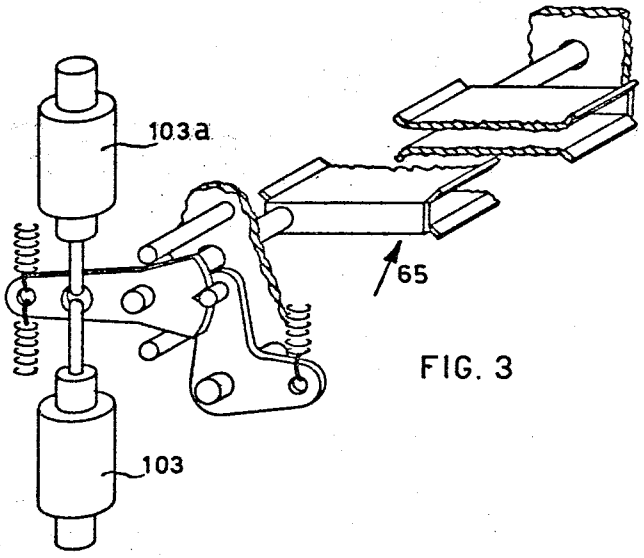
FIG. 3 is a perspective view of a sheet deflecting device for the copying machine of FIG. 1.

The side of the tray 35 and 40 viewed in FIG. 1 corresponds therefore to the lesser dimension of the sheets therein contained. A sheet deflector 65 is mounted at the output of the fixing unit 25, and is selectively positionable in one of three positions by the selective energization of electromagnets 103 and 103*a* (FIG. 3):

(a) first position (electromagnet 103 energized and 103*a* deenergized) in which it deflects a copy sheet towards the top of the machine and guides the sheet through a pair of rollers 67 advancing the sheet in a vertically positioned finished copies collection tray 29;

(b) a second position (electromagnets 103 de-energized and 103*a* energized) in which it deflects the copy sheet towards the bottom of the machine and guides the sheet through a pair of rollers 69 advancing the sheet to the multiformat tray 40 positioned in the feeding station 43 for the execution of the duplexing feature according to the operations which will be described later.

(c) a third position (electromagnet 103 and 103*a* de-energized) in which it guides the copy sheet through a pair of rollers 68 advancing the sheet towards a sorter (not shown in FIG. 2) which can be connected to the copying machine as described in allowed U.S. patent application Ser. No. 875,291, filed Feb. 2, 1978 now U.S. Pat. No. 4,200,278.

Along the copy sheet path, from the feeding station 43 to the exit from the fixing unit 25 a plurality of microswitches 71, 72, 73, 74 and 75 are mounted, which are switched on by the passage of the copy sheet and generate, upon switching on, digital signals at logical one level MR1, MR2, MR3, MR4 and MR5, respectively, on wires 76, 77, 78, 79 and 80, respectively, connected to the control unit of the machine (FIGS. 1 and 7).

Figure 4:
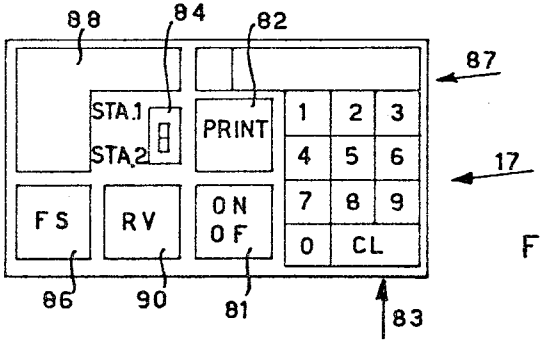
FIG. 4 is a planar view of the control panel of the copy machine of FIG. 1.

The control panel 17 (FIG. 4) of the copying machine comprises:

an ON-OFF key 81;

a "PRINT" key 82 for starting the execution of a copy run by sending a digital signal PRI at logical One level on wire 250 (FIG. 7), when actuated, with the machine switched on.

A numeric keyboard 83 (FIG. 4) for entering the desired number of copies to be executed during the copy run into a memory register 107 and into a copy counter 108 of the control unit (FIG. 7) of the machine;

a selector 84 (FIG. 4) for selecting one of the two feeding stations 42 or 43 from which the copy sheets are fed. The selector 84 generates a digital signal SEL (FIG. 7) for the control unit, which is at logical One level when the station 43 is selected, (selector 84 in the position STA2) and at logical Zero level when the station 42 is selected (selector 84 in the position STA1);

A key 86 (FIG. 4), for enabling the connection of the machine to a sorter, which sends a digital signal FS at logical One level to the control unit (FIG. 7);

A first display 87 (FIG. 4) connected to the copy counter 108 (FIG. 7) for displaying the number of copies still to be executed, in the copy run, set by the keyboard 83 and decremented after execution of each copy;

A second display 88 (FIG. 4) conncted to the control unit and suitable to display either alphanumeric characters corresponding to the format of the copy sheets contained in the tray 35 or 40 which is positioned in the feeding station selected by the selector 84, or predetermined messages to the operator indicating errors in the copy procedure or machine defects;

A key 90 (RV) for the predisposition of the machine to the execution of the duplexing mode copy-run. The key 90, when set, sends to the control unit a digital signal RV at logical One level (FIG. 7).

According to the present invention each feeding device 51 or 52 (FIG. 2) comprises a hollow cylinder 60 having a plurality of suction parts 61 aligned along a generatrix of the cylinder 60 and communicating with a tube 62, connected by a flexible conduit 63 to a suction pump not shown in figure. The cylinder 60 is rotatably mounted at the ends of a pair of levers 55 fulcrumed on pin 57 and rigidly connected therebetween. A pair of gears 31 is keyed to the opposite ends of the tube 62 and meshes with toothed slots 37 of the side structure of the machine.

The pair of levers 55, 56 is connected to a connecting rod-crank device 85, moved by the shaft 89, which oscillates the pair of levers 55, 56 around the fulcrum 57.

The shaft 89 is rotated by the motor shaft 70 through a clutch device actuated by the electromagnet 91.

Figure 2:
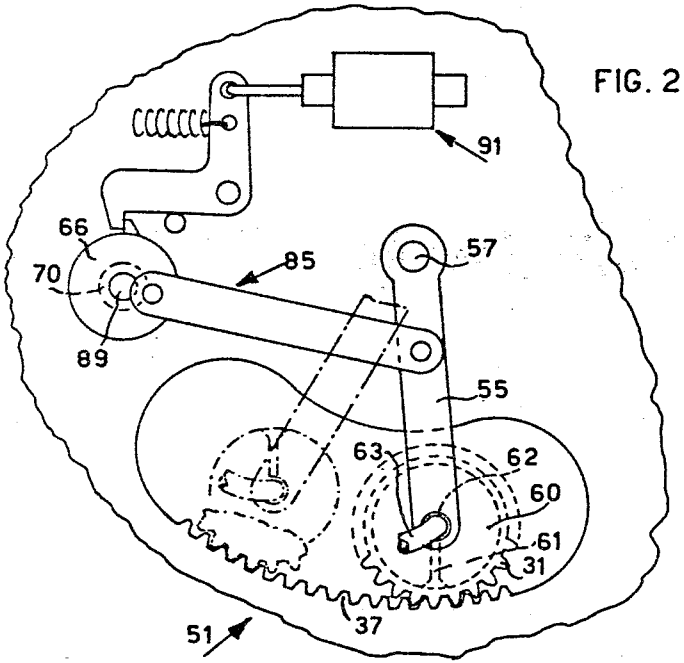
FIG. 2 is a front view of a sheet feeding device of the copy-machine of FIG. 1.

At the beginning of a copy-cycle the feeding device 51 is in the position indicated in full line in FIG. 2, with the suction ports 61 directed to the bottom. At a suitable instant of the copy-cycle, in synchronism with the rotation of the drum 11, the shaft 89 is rotated by one anti-clockwise turn through the clutch device 66.

Figure 6:
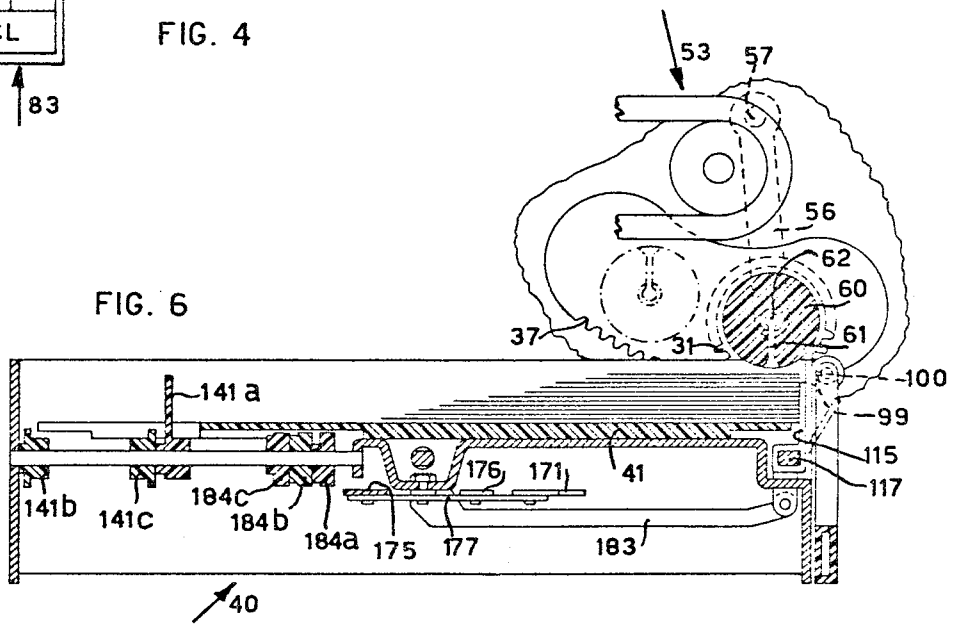
FIG. 6 is a sectional view taking in the line of IV—IV of the tray 40 of FIG. 5.

During the first 180° of this turn, the pair of levers 55, 56 is swung to the position shown in dashed line in FIG. 2 and, the gears 31, by meshing with the slot 37, rotate by 180° the suction ports 61 which take up a copy-sheet from the tray 35 or 40 and deliver it, turned upside down, to the conveyor 53 (FIG. 6).

When the levers 55, 56 reach the dashed position and the suction ports 61 are in correspondence with the conveyor 53, the suction through the ports 61 is interrupted and the copy sheet adheres to the suction belts of the conveyor 53.

During the successive rotation of 180° completing the turn, the levers 55 and 56 and the cylinder 60 are returned to their rest position.

In order to allow separation of the sheets of the stack and the feeding of a single sheet by the feeding device 51 or 52 (FIG. 6), each feeding station 42 or 43 comprises a plurality of nozzles 99 connected to a conduit 100 mounted adjacent and parallel to the leading edge of the sheets contained in the tray 35 or 40.

Each conduit 100 is connected to the delivery side of the suction pump, whereby the nozzles blow an air jet tangentially to the first sheets of the stack.

Figure 8A:
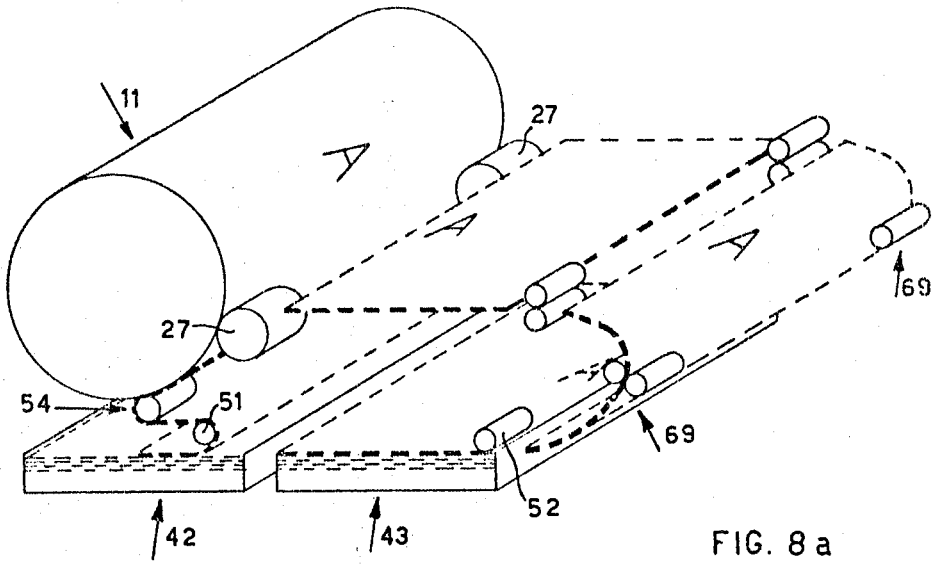
FIG. 8*a* is a perspective diagrammatic view of the copy-sheet path during execution of the first duplexing mode copy run form imaging one side of a copy sheet.
Figure 8B:
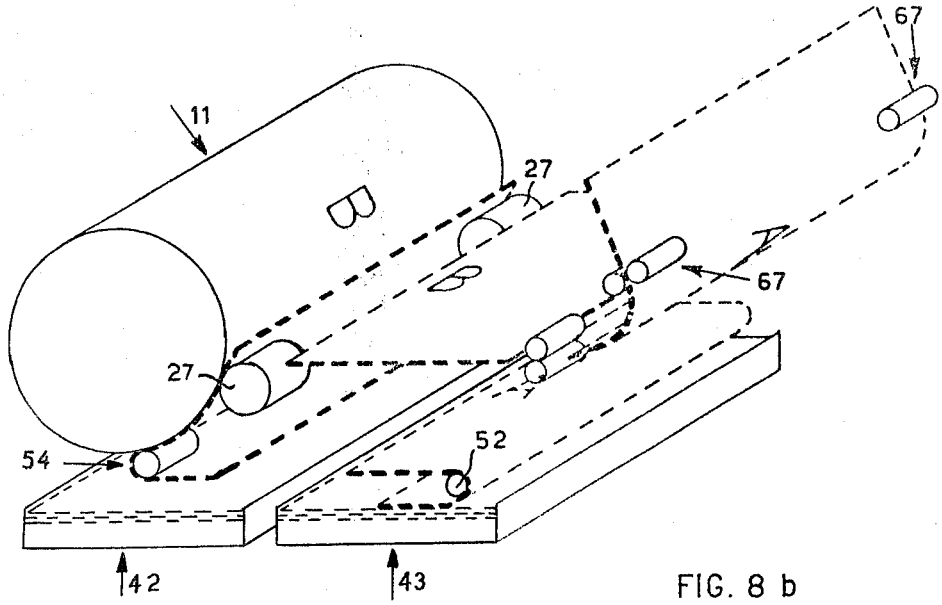
FIG. 8*b* is a perspective sketchy view of the copy-sheet path during execution of the second duplexing mode run for imaging the other side of the copy sheet.

According to the present invention for executing a duplexing mode copy-run (RV=1), the copy machine executes a first copy run (FIG. 8*a*) feeding copy-sheets from the feeding station 42, with the deflector 65 positioned for deflecting the copy-sheets towards station 43, so collecting the one side imaged copy-sheets into the multiformat tray 40 positioned in the station 43, with the imaged side faced down. After having changed the original to be reproduced on the illumination plane 30, the machine executes a second copy-run with the deflector 65 positioned in one of the two positions in which it deflects the copy-sheets towards the collecting tray 29 (FS=0) or toward the shorter connected to the machine (FS=1), and feeds the copy sheets from the station 43, whereby the second side of the copy sheets, temporary collected in the station 43, is imaged (FIG. 8*b*) and then the both sides imaged copies are collected in the tray 29 or in the sorter connected to the machine.

As already said, according to the invention, in order to allow the duplexing execution mode, the copy machine includes a multiformat tray 40 (FIGS. 5 and 6) suitable to collect and store sheets of whatsoever format handled by the machine, which must be positioned in the feeding station 43. The multiformat tray 40 has a supporting plane 41 which is raised by a system of scissors lever 116 (FIG. 1), of known type, mounted in the station 43 for holding the first sheet of the stack contained therein ready to be fed, independently of the height of the stack.

A front edge stop 115 is movable between the vertical position indicated by full line in FIG. 6 and an inclined position indicated by dashed line, by rotation of the pin 117 to which the stop is connected.

Lateral edge stops 130 and 131 are symmetrically disposed with respect to the midlle axis of the tray 40 and pass through the slots 120 and 121 of the plane 41.

The lateral edge stops 130 and 131 includes a plurality of tongues 130*a*, 130*b*, 130*c* and respectively, 131*a*, 131*b*, and 131*c* mounted at 90° with respect to each other on sleeves 134 and respectively 135, slidable and rotatably mounted on a shaft 136 extending under the plane 41.

Each of the tongues pair 130*a*, 131*a*; 130*b*, 131*b*; and 130*c*, 131*c*; constitute a pair of lateral stops for a distinctive one of the formats handled by the machine.

The rear edge stops 140 and 141 include a plurality of tongues 140*a*, 140*b*, 140*c*, and respectively 141*a*, 141*b*, 141*c*, keyed at 90° with respect to each other on shafts 150 and 151 extending under the plane 41 perpendicularly to the shaft 136.

Each pair of tongues 140*a*, 141*a*; 140*b*, 141*b*; 140*c*, 141*c* constitutes a pair of rear edge stops for a distinctive one of the formats handled by the machine.

The following table III shows the correspondence between each format and the tongues pair.

TABLE III

| FORMAT | LATERAL STOPS | REAR STOPS |
|---|---|---|
| UNI A4 | 130a 131a | 140a 141a |
| UNI B4 | 130b 131b | 140b 141b |
| PROTOCOLLO | 130c 131c | 140c 141c |

Frusto conical gears 160 and 161 are keyed on shafts 150 and respectively 151 and mesh with corresponding frusto conical gears 163 and 164 keyed on a shaft 136.

A knob 170 is rigidly connected to the shaft 136 outside of the tray 40, which is movable among three positions I, II, and III, each corresponding to the selection of one of the copy sheets format handled by the machine. When the knob 170 is settled in position I, for instance, the tongues 140*a*, 141*a*, 130*a*, 131*a* which constitute the edge stops for the format UNIA4 are vertically positioned through the slots 120, 121 of the supporting plane 41, and so on for the other knob's positions. The sleeves 134 and 135 are fixedly connected to cursors 175 and, 176 respectively, which are articulately connected to the opposite ends of a lever 177, fulcrumed on a pin 179. The lever 177, comprises an arm 180, articulately connected to a bar 183 integral with the shaft 117 of the front edge stops 115.

The lever 177 is also articulately connected to a bar 171 cooperating with a lever 172. The lever 172 is rotated around its fulcrum by the cam 182 rotatably mounted on the shaft 169 and through the connecting rod 181.

The cam 182 receives the rotational motion from shaft 169 by a clutch device 167, of known type, actuated for incremental rotations of 360°, by the electromagnet 165. The cam 182 is rotated in synchronism with the rotation of the drum 11 in such a manner that, when the rear edge of the copy-sheets advanced into the tray 40 is about to contact the rear edge stops 140, 141, the lever 172 is moved away from the bar 171 and a spring 168 urges the lever 177 in counterclockwise rotation whereby both the sleeves 134 and 135 and the corresponding lateral edge stops 130 and 131 are moved away from the middle axis of the tray 40. Contemporaneously, due to the shifting of the bar 183, the front edge stop 115 is rotated to the dashed line position of FIG. 6. Because of the above described actions, the rear edge of the copy sheet touches the rear edge stops 140, 141, and recoils towards the front edge stop 115. Contemporaneously the cam 182 completes its 360° rotation and the lever 172 pushes against the bar 171 whereby the copy sheet is correctly registered frontally, by the return to the vertical position of the front edge stop 115, and laterally by the reapproaching of the lateral edge stop 130 and 131 toward the middle axis of the tray 40. As already said, in order to provide coded information indicating the format selected by the knob 170, on the shaft 151 are keyed three code-cams 184*a*, 184*b*, 184*c* which cooperate with the bars 34*a*, 34*b*, and 34*c* selectively actuating the microswitches 39*a*, *b*, *c*.

The microswitches 39*a*, 39*b*, 39*c* are connected to a voltage source whereby by their selective switching on, a 3 bits-binary code corresponding to the selected format (see Table 2, above) is furnished on the wires 45*a, b, c.*

The control logic unit of the copy-machine (FIG. 7) comprises a flip-flop 101 which is set (output VAI=1) by the digital pulse PRI on the wire 250, generated at each actuation of the PRINT key 82.

The rising to logical one level of the output VAI of the flip-flop 101 causes the start of the rotation of the drum 11 for the execution of a copy cycle.

A strobe disc 18 (FIG. 1) is keyed on the shaft 12 of the drum 11 and includes a plurality of circular regularly spaced notches 19 which are detected, during rotation, by a photoelectric detecting device 105, of known type.

Figure 9:
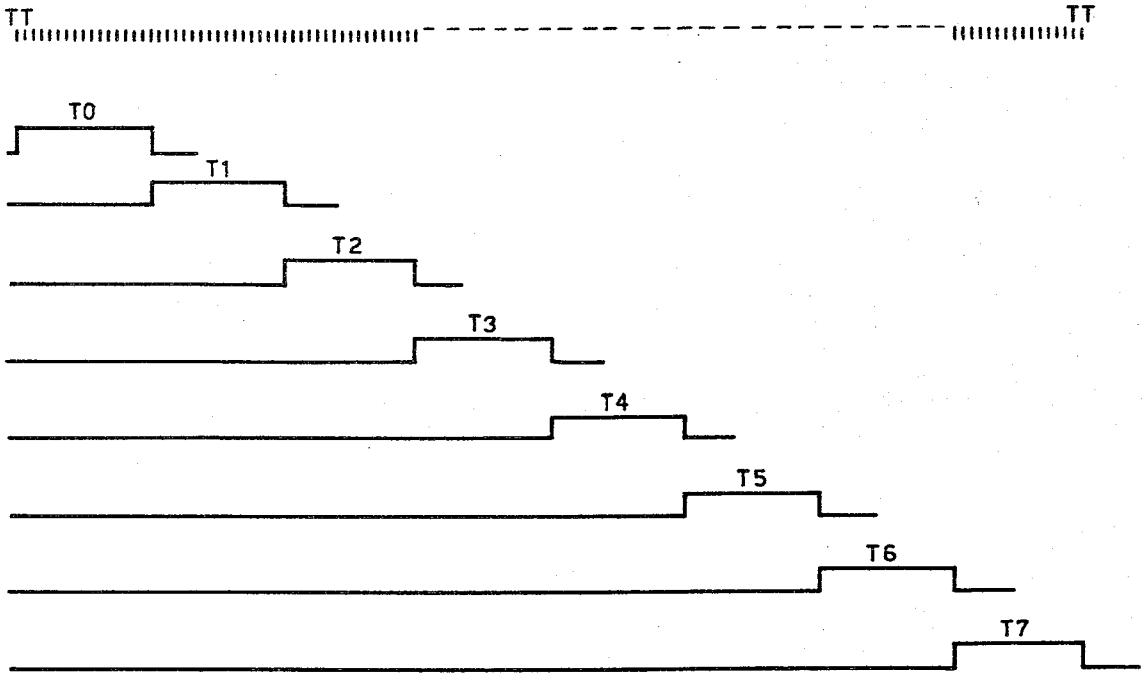
FIG. 9 is a timing diagram of the control signals generated by the control unit of FIG. 7.

The detecting device 105, upon detection of notches 19 sends corresponding timing signals TT on the wire 16 to a timing circuit 104 which generates in its output the timing signals T0, T1, T2, 73, T4, T5, T6 and T7 (FIG. 9) for each rotation by 180° of the drum 11.

The signals T0–T7 are sent through the channel 96, to a synchronizing unit of known type 127, which enables the usual devices and stations of the copy machines in timing relation with the rotation of the drum 11.

Upon reception of each signal PRI the content of the memory register 107 is stored in the counter 108. Another counter 109 is incremented by one unit by the signals PRI through the AND gate 110 enabled by the logical conditions: RV=1 and NON=a. The outputs 111 of the counter 109 are decoded by the decoder 112 which generates a digital signal at logical one level DISP on the output wire 113, if the number stored in the counter 109 is different from zero and odd.

The counter 109 is reset to zero by the rising of the signal RV at logical one level. The logical AND 114 of the signals RV and DISP enables, when the signal on its output 97 is at logical one level, the energizing circuit of the electromagnet 103*a*.

Therefore the deflector 65 guides the copy sheets to the feeding station 43 when, being selected the duplexing mode of operation (RV=1), an odd-copy run (DISP=1) is executed.

The AND gate 114 further enables the display 88 to display the message: "1° DUPLEXING RUN."

The logic circuit 119 executes the logic function:

$$CL=RV\cdot\overline{DISP}\cdot\overline{FS}+\overline{RV}\cdot\overline{FS}$$

(where the simbols "·""+" and "¯" indicate the elementary logic operations AND, OR, and Negation). The output 124 of the circuit 119, when CL=1, enables the energization circuit 125 of the electromagnet 103. Therefore the deflector 65 guides the copy-sheets in the finished copy collection tray 29 if the duplexing mode and the sorter have been selected (RV=0, FS=0) or, alternatively, if duplexing mode has been selected and even copy-run is on execution and the sorter has not been selected (FS=0, RV=1, DISP=0).

The AND 168 of the signals DISP, negated and RV enables the display 88 to display the message:

"2° DUPLEXING COPY RUN"

The logic circuit 205 executes the logic operation $AL=RV\cdot\overline{DISP}+\overline{RV}\cdot SEL$ and, when AL=1, enables the feeding station 43 and causes through the AND gate 129, conditioned by the signal BV=0indicating the presence of sheets in the station 43, the energization of the electromagnet 91 of the station 43 according to the timing signals generated by the synchronization unit 127. On the contrary, when AL=0, the feeding station 42 is enabled by the circuit 205 and the corresponding electromagent 91 is energized with a suitable timing through the AND gate 133, enabled by the condition AV=0 (indicating the presence of sheets in the station 42).

Therefore with RV=0 the feeding station selected through the selector 84 is enabled; while, with RV=1, the feeding station 42 if an odd copy-run is executed, (DISP=1) is enabled and the feeding station 43, if an even copy-run is executed, (DISP=0) is enabled, independently of the selection made by the selector 84.

Moreover, when AL=0 and RV=1 the electromagnet 165 is also energized through the AND gate 132 and according to the timing signals generated by the synchronization unit 127, whereby the copy sheets advancing into the feeding station 43 are properly registered in the multiformat tray 40.

A logical circuit 138 executes the logical function:

$$MC=(AV\cdot\overline{AL}+BV\cdot AL)\cdot VAI$$

The circuit 138, with MC=1, conditions the display unit 88 to display the message "OUT OF PAPER."

A comparator 139 compares the first two bits of the format codes present on channels 44 with the corresponding bits present on channel 45 and if the compared bits are equal, sets the digital signal UGU at logical one level on its output 291.

The AND 128 of the third bit, negated, present on channel 45*a*with the signal RV, and the AND 137 of the signals UGU and RV are connected in input to the OR 142 the output ERV of which, conditions, when at logical one level, the display 88 to display the message:

ERROR ON SETTING DUPLEXING MODE, since $$ERV=MUL\ negated\cdot RV+UGU\cdot RV$$

is at logical one level when in the station 43 is not present the multiformat tray 40 (MUL=0) or, when the tray 40 is present but the format selected by the knob 170 is not equal to the sheet format present on the tray 35 of the station 42.

The signal MR1–MR5 generated by the microswitches 71–75, respectively, upon actuation due to the passage of the copy sheet causes, with a timing defined by the signals T1–T5 respectively, the setting of the flip-flops 145–149, respectively, and therefore the rising of their outputs FF1–FF5 to logical one level.

The logical circuit 144 executes the logical function:

$$MOV=FF1\cdot AL+FF2\cdot\overline{AL}$$

The condition MOV=1 identifies, therefore, the executed correct feeding of the copy sheet from the enabled station. In fact the microswitches 71 and 72 are located near the exit of the feeding stations 42 and 43, respectively.

The output FF2–FF4 of flip-flops 146–148 enable, when at logical zero level and when MOV=1, the AND gates 152–154, respectively, which, with the signals T3–T5, respectively, cause the setting of the flip-flops 156–158 and therefore the rising of their outputs FF6–FF8 at logical one level. The output FF5 when at logical one level and when RV=1, DISP=1 and MOV=1, and with the timing signal T6=V, causes the setting of the flip-flop 159 raising its output FF9 at logical 1 level.

FF6÷FF9 when at logical 1 level

The outputs condition the display 88 to display the message:

JAM—X— where X is one of the number associated with numbers 6–9 which is associated with the flip-flop 156–159 respectively which has been set, and indicates the position along the copy-sheet path in which the jam happened.

In fact one of the flip-flops 156–159 is set only if the copy-sheet, after having actuated one of the microswitches 71–74, does not actuate the following microswitches 72–75, respectively, due to a jam of the sheet in the zone comprised between the two microswitches. In particular flip-flop 159 is set only when the duplexing mode is selected (RV=1), an odd copy run is executed (DISP=1) and after actuation of microswitch 74, actuation of microswitch 75 does not occur.

The logical circuit 326 executes the function:

$$MAN: AL\cdot\overline{FF1}\cdot T2+\overline{AL}\cdot\overline{FF2}\cdot T3$$

which is at logical one level, if being enabled the station 42, during the timing signal T2 the flip-flop 145 is not set, or if being selected the station 43, during the timing signal T3 the flip-flop 146 is not set. Therefore the rising at logical one level of the signal MAN indicates that the feeding of the copy-sheet has not been executed.

A counter 190 is incremented by one unit each time the signal MAN rises at logical one level. The counter 190 counts, therefore, the number of errors in the feeding operations. The outputs 191 of the counter 190 are decoded by the decoder 192. The output U3 of the decoder 192 is at logical one level only when the number stored in the counter is three.

The output U0 of the decoder 191 rises at logical one level only when the counter 190 is zeroized.

Each rising at logical one level of the signal MOV decrements the counter 190, through the AND gate 194 enabled by the condition U0=0.

The counter 190 is zeroized by the signal PRI at each actuation of the key 82 "PRINT."

The counter 190 allows the machine to executes three consecutive miss-feeding of copy-sheets, thereafter the rising at logical one level of the signal U3 conditions the display 88 to display the message "MISS-FEEDING" which informs the operator of some failures in the feeding devices 51 or 52 of the feeding station 42 or 43 selected.

Only when U0=1 the actuation of the image transfer device 23 of the pick off devices 20 and 27 and of the fixing unit 25 by timing signals generated by the synchronization unit 127, is enabled through the AND gates 195, 196, 197.

The condition U0=1 further enables, through the AND gate 198, the decrement by one unit, by the timing signal T7, of the counter 108 storing the number of copies still to be executed in the copy-run in course of execution.

The output ZER of the counter 108 rises at logical one level only when the counter 108 is zeroized.

The synchronization unit 127 is enabled to send the timing signals for the actuation of the devices, units and stations by the rising at logical one level of the output of the AND 199 among the signals JA, ERV, MC, U3, ZER, VAI;

where JA is the OR of the outputs FF6–FF9 of the flip-flops 156–159, respectively.

The logical function: STO=JA+U3+ERV+MC, executed by the OR 200, enables, when at logical one level, the AND gate 201, through which the flip-flop 202 is set by a timing signal TT. The output NON of the flip-flop 202, rised at logical one level, disables the AND gate 110.

The flip-flops 145–149 are reset at the end of each copy-cycle by the signal T7 through the AND 203 enabled by the condition VAI=1, while the flip-flops 156–159 are reset by the signal TO through the AND 204 enabled by the condition VAI=1.

The logical function ALT executed by the logical circuit 375:

$$ALT=STO\cdot TT+T8\cdot ZER$$

causes, when at logical one level, the reset of the flip-flop 101, interrupting the copy-run in execution.

The copy-run is therefore interrupted at the end of the execution of a number of copies equal to the number set by the numeric keyboard 83 in the counter 108 (ZER=1) or during the copy-run, if failures or jams occurr (STO=1).

In this last case (STO=1), if RV=1, when the operator has removed the failure or jam and restarts the copy-run by the key PRINT 82, the signal PRI, so generated, does not increment the counter 109 since the AND gate 110 is disabled by the condition NON=1.

In order to execute a duplexing mode copy-run the operator executes the following timely ordered operations:

(1) selection of the duplexing mode by the selector key 90 (RV=1)

(2) check, through the selector 84 and the display 88, whether in the station 42 is present a monoformat tray 35 containing copy-sheets of the desired format, and whether in the station 43 is present a multiformat tray 40 having the knob 170 selecting the edge stops for a format equal to that present in the station 42 (AV=0, MUL=1, UGU=1).

(3) Selection, if desired, of the output sorter by the selector key 86.

(4) Enter through keyboard 83 the number of copies to be executed in the copy-run, which is stored in the register 117.

(5) position on the illumination plane 30 the original to be reproduced on the first side of the copy sheets.

(6) Start the first duplexing mode copy run by the PRINT KEY 82 which lighted up. The copy run is executed and the copies collected in the feeding station 43.

(7) At the end of the first duplexing mode copy run, with the key 82 switched off, the display 87 visualizing the number 0 and the counter 108 zeroized, change the original, by positioning on the illumination plane 30 the original to be reproduced on the second face of the copies.

(8) Again depression of the PRINT key 82 which starts the second duplexing mode copy-run and causes the storing in the counter 108 of the content of the register 107, whereby the display 87 again displays the initially entered copy number.

At the end of the second copy-run the both side imaged copies are collected in the tray 29 if FS=0 or in the sorter, if FS=1.

It is to be understood that the invention shall not be considered limited to the use of a control unit employing discrete logical components such as flip-flops AND, OR.

The control unit could be a microprocessor of known type having stored in its memory a microprogram suitable to execute the control of the above described various operations of the machine.

While the present invention, as to its objects and advantages has been described herein as carried out in specific embodiments thereof, it is not desired to be limited thereby; but it is intended to cover the invention broadly within the scope of the appended claims.

I claim:

1. Electrophotographic copying machine comprising:

a photoconductive member;

means for cyclically moving said photoconductive member along an endless path;

a plurality of stations positioned adjacent and regularly spaced along said endless path for the execution of the usual copy process steps, including:

a member charging station, a member developing station, a transfer station, a copy sheet pick off station and a member cleaning station;

a copy sheet fixing station spaced apart from said endless path;

first and second, selectively enabled, copy sheets supply stations spaced apart from said endless path;

first conveying means for conveying a copy sheet along a copy sheet path starting from said first or second supply station and passing through said transfer, pick off and fixing stations in order;

storage means in each of said supply stations for storing a stack of copy sheets;

a feeding device in each of said supply stations, including means for picking up the first sheet of the stack and means for turning it upside down and for thereafter delivering it to said first conveying means;

means defining an exit from the machine to a sheet collector;

second conveying means for conveying a finished copy sheet from the output of the fixing station into the storage means of said first supply station;

deflecting means at the output of said fixing station selectively positioned in a first or second position in which it deflects a finished copy sheet toward said exit or toward said second conveying means, respectively;

means for defining a simplex or duplex mode of operation for the machine;

selecting means for enabling said first or second supply stations in said simplex mode of operation;

means for setting a desired number of copies;

copy cycle executing means actuable for the execution of a number of copy cycles equal to said desired number, during each of which a copy sheet fed from the enabled supply station is imaged along a copy sheet path and delivered at the output of said fixing station;

first control means enabled in said simplex mode for positioning said deflector in said first position and for thereafter actuating said copy cycle executing means;

second control means, enabled in said duplex mode of operation for positioning said deflector in said second position, for enabling said second supply station and for thereafter actuating said executing means whereby the desired number of one-side imaged copy sheets are stored in the storage means of said first supply station; and third control means, enabled in said duplex mode after completion of operation of said second control means, for positioning said deflector in said first position, for enabling said first supply station and for thereafter actuating said executing means, whereby the desired number of both sides imaged copy sheets are delivered to said exit, said deflector having a third position in which it deflects finished copy sheets towards a sorter-exit of the machine and means for selectively positioning said deflector in said third position in said simplex mode, or in said duplex mode, during operation of said first or third control means, respectively.

2. An electrophotographic copying machine having the capacity of copying on copy sheets of a plurality of selectable formats both in simplex and duplex mode of operation, comprising:

a photoconductive member;

means for cyclically moving said photoconductive member through an endless path;

a plurality of stations positioned along said path for the execution of the usual copy process steps including:

a charging station, an exposure station, a developing station, a transfer station, a copy sheet pick off station and cleaning station;

a fixing station spaced apart from said endless path;

first and second selectively enabled sheets supply stations each having storage means for storing a stack of copy sheets of a selected format;

first conveying means for conveying a copy sheet fed from the enabled one of said supply stations through said transfer, pick off and fixing stations to form a finished copy image on one side of the copy sheet;

a feeding device in said first supply station including: means for picking up the first copy sheet of the stack, means for turning the picked up copy sheet upside down and means for thereafter delivering the turned sheet to said first conveying means;

second conveying means, selectively enabled in said duplex mode of operation, for conveying one side imaged sheets from the exit of the fixing station into the storage means of said first supply station;

a plurality of edge stops in said storage means of said first supply station selectively positioned for storing sheets of a corresponding format;

first control means operative during the duplex mode for enabling said second supply station and said second conveying means for controlling the execution of a first copy run during which a predetermined number of copy sheets are one side imaged with the image of a first original and thereafter stored in the storage means of said first supply station;

second control means, operative during said duplex mode at the completion of operation of said first control means for enabling said first supply station for disabling said second conveying means and for controlling the execution of second copy run during which the predetermined number of copy sheets are imaged on the other side with the image of a second original;

the storage means of said first supply station including a container for the stack having a movable stack support plane upon which the stack is positioned, means for raising the support plane for maintaining the first sheet of the stack in contact with the feeding device, a plurality of pairs of lateral and front edge stops each pair of stops corresponding to a copy sheet format and the stops of each pair having rest positions under the support plane, and operative positions in which they extend through slots in the plane for registering a stack of sheets of the corresponding format, and selector means connected to each front and lateral edge stops pair for contemporaneously moving selected lateral and front stops corresponding to a selected format into operative position, the lateral edge stops being mounted axially spaced in different angular positions and in correspondence with said slots on a first shaft extending under said support plane, the front edge stops being mounted axially spaced in different angular positions and in correspondence with said slots on a second shaft extending perpendicularly to said first shaft under said support plane, means being provided for rotationally connecting said first and second shafts to each other and a selector being provided for contemporaneously selectively adjusting said shafts into a plurality of angular positions in each of which the front and lateral edge stops, corresponding to a selected format, extend through said slots.

3. An electrophotographic copying machine having the capacity of copying on copy sheets of a plurality of selectable formats comprising:

a copying device;

a supply station including a container for storing a stack of copy sheets of one of said formats, said container having a movable stack support plane upon which the stack is positioned;

conveying means for conveying a copy sheet fed from the said plane through said copying device;

a feeding device in said supply station including means for picking up and turning upside down the first copy sheet of the stack and means for delivering the turned sheet to said conveying means;

means for raising the support plane for maintaining the first sheet of the stack in contact with the feeding device;

a plurality of pairs of lateral and front edge stops each pair corresponding to a copy sheet format and the stops of each pair having rest positions under the support plane and operative positions in which they extend through slots of said plane for registering the stack of sheets of the corresponding format, the lateral edge stops and the front edge stops being mounted axially spaced in different angular positions and in correspondence with said slots on a pair of mutually perpendicular shafts extending under said support plane;

connecting means for rotationally connecting said shafts; and a selector for contemporaneously selectively positioning said shafts in a plurality of angular positions in each of which the front and lateral edge stops corresponding to a selected format extend through said slots.

4. An electrophotographic copying machine comprising a copying device;

first and second, selectively enabled, copy sheet supply stations, each of said supply stations including storage means for storing a stack of copy sheets;

first conveying means for conveying a copy sheet along a path starting from said first or second supply station and passing through said copying device;

a feeding device in each of said supply stations including means for picking up the first sheet of the stack and means for turning it upside down and thereafter delivering it to said first conveying means;

second conveying means for conveying a finished copy sheet from said copying device into the storage means of said first supply station;

a deflector at the exit of said copying device selectively positioned in a first or second position in which it deflects a finished copy sheet toward the output of the machine or toward said second conveying means respectively;

means for defining a simplex or duplex mode of operation for the machine;

selecting means for enabling said first or said second supply station in said simplex mode of operation;

copy cycle executing means actuable for execution of a predetermined number of copy cycles during each of which a copy sheet fed from the enabled supply station is imaged and delivered at the exit of said copying device;

first control means enabled in said simplex mode for positioning said deflector in said first position and for thereafter actuating said copy cycle executing means;

second control means, enabled in said duplex mode of operation for positioning said deflector in said second position, for enabling said second supply station and for thereafter actuating said executing means whereby the predetermined number of one-side imaged copy sheets are stored in the storage means of said first supply station, and third control means, enabled in said duplex mode after completion of operation of said second control means, for positioning said deflector in said first position, for enabling said first supply station and for thereafter actuating said executing means, whereby the predetermined number of both sides imaged copy sheets are delivered to the exit of the machine, said deflector having a third position in which it deflects finished copy sheets towards a sorter-exit of the machine and means for selectively positioning said deflector in said third position in said simplex mode, or in said duplex mode, during operation of said first or third control means, respectively.

5. An electrophotographic copying machine, comprising a copying device;

first and second selectively enabled copy sheets supply stations, each having storage means for storing a stack of copy sheets of predetermined format;

collecting means for collecting finished copy sheets;

sorter exit means;

means for selectively defining a simplex and a duplex mode of operation of the machine;

first conveying means for conveying a copy sheet fed from the enabled one of said supply stations, through said copying device to form a finished copy imaged on one side of a copy sheet, toward said collecting means;

second conveying means, selectively enabled in said duplex mode, for conveying a one side imaged copy sheet from said copying device into the storage means of said first supply station;

third conveying means for conveying a finished copy sheet from said copying device toward said sorter exit means, and three-way deflecting means, located at the output of said copying device, selectively actuable for directing a finished copy sheet toward a selected one of said first, second and third conveying means.

6. An electrophotographic copying machine according to claim 5, further comprising:

copy cycle executing means actuable for executing a preselected number of copy cycles during each of which a copy sheet fed from an enabled one of said supply stations is processed and delivered at the output of said copying device;

first control means enabled in said simplex mode for positioning said deflecting means to direct imaged copy sheets toward said collecting means and for thereafter actuating said executing means to image a copy sheet on one side;

second control means enabled in said duplex mode for positioning said deflecting means to direct imaged copy sheets toward said storage means and for thereafter actuating said executing means, whereby a preselected number of one side imaged copy sheets are temporarily stored in the storage means of said first supply station;

third control means, selectively enabled in said duplex mode after completion of operation of said second control means, for enabling said first supply station and for thereafter actuating said executing means; and means for selectively positioning said deflecting means to direct imaged copy sheets toward said sorter exit means in said simplex and in said duplex mode during operation of said first or third control means respectively, whereby the preselected number of both sides imaged copy sheets are delivered through said sorter exit means for collection in said sorter.

* * * * *